US010478873B2

(12) United States Patent
Ruan et al.

(10) Patent No.: US 10,478,873 B2
(45) Date of Patent: Nov. 19, 2019

(54) VENTILATION CABINET

(71) Applicant: E3 Green Technology Co., Ltd., Shanghai (CN)

(72) Inventors: Hongzheng Ruan, Shanghai (CN); Guangye Tang, Naperville, IL (US); Bingli Lu, Ningbo (CN)

(73) Assignee: E3 Green Technology Co., Ltd., Shanghai (CN)

( * ) Notice: Subject to any disclaimer, the term of this patent is extended or adjusted under 35 U.S.C. 154(b) by 0 days.

(21) Appl. No.: 15/309,461

(22) PCT Filed: Jan. 18, 2016

(86) PCT No.: PCT/CN2016/071209
§ 371 (c)(1),
(2) Date: Nov. 8, 2016

(87) PCT Pub. No.: WO2016/161834
PCT Pub. Date: Oct. 13, 2016

(65) Prior Publication Data

US 2017/0182527 A1 Jun. 29, 2017

(30) Foreign Application Priority Data

Apr. 10, 2015 (CN) ..... 2015 2 0216778 U

(51) Int. Cl.
*B08B 15/02* (2006.01)
*B01L 1/04* (2006.01)
(Continued)

(52) U.S. Cl.
CPC ..... *B08B 15/02* (2013.01); *B01L 1/04* (2013.01); *B08B 15/023* (2013.01); *B25H 1/20* (2013.01);
(Continued)

(58) Field of Classification Search
CPC ..... B08B 15/00; B08B 15/02; B08B 15/023; B01L 1/04; B01L 2300/0681; B25H 1/20; F24F 3/1607
(Continued)

(56) References Cited

U.S. PATENT DOCUMENTS 3,318,076 A * 5/1967 Baker ..... B08B 15/023 454/56
3,895,570 A * 7/1975 Eagleson, Jr. ..... B08B 15/02 454/57
(Continued)

FOREIGN PATENT DOCUMENTS

CN 101274327 A 10/2008
CN 103272818 A 9/2013
(Continued)

OTHER PUBLICATIONS

International Search Report (including English translation) for related International Patent Application No. PCT/CN2016/071209, dated Apr. 12, 2016.
(Continued)

*Primary Examiner* — Steven B Mcallister
*Assistant Examiner* — Allen R Schult
(74) *Attorney, Agent, or Firm* — Troutman Sanders LLP; James E. Schutz; Tiffany Palmer Bell

(57) ABSTRACT

A fume hood comprising: a hood, a work chamber, and a front wall formed with an opening toward an indoor environment; an air supply system, and an air exhaust system to discharge air that enters the work chamber through a front opening and enters the work chamber through the air supply system, out from the work chamber; the air supply system provided with at least one air supply outlet in an upper portion and a lower portion of the hood, and the air supply outlet supplying air towards the work chamber. The fume
(Continued)

hood can reduce energy consumption of air conditioning and suppress overflowing of harmful substances in the work chamber, with a low installation cost and a high consistency of product quality.

6 Claims, 6 Drawing Sheets

(51) Int. Cl.
*B25H 1/20* (2006.01)
*F24F 3/16* (2006.01)

(52) U.S. Cl.
CPC ..... *F24F 3/1607* (2013.01); *B01L 2300/0681* (2013.01)

(58) Field of Classification Search
USPC ..... 454/56, 58, 68, 49, 66, 57, 61, 59
See application file for complete search history.

(56) References Cited

U.S. PATENT DOCUMENTS 4,528,898 A * 7/1985 Sharp ..... B08B 15/023 454/61
4,741,257 A * 5/1988 Wiggin ..... B08B 15/023 454/255
5,240,455 A * 8/1993 Sharp ..... B08B 15/023 454/343
6,302,779 B1 * 10/2001 Ryan ..... B08B 15/023 454/56
6,428,408 B1 * 8/2002 Bell ..... B01L 1/50 454/56

FOREIGN PATENT DOCUMENTS

CN 203972435 U 12/2014
CN 204710833 U 10/2015
DE 102013000768 A1 7/2014
GB 2064100 A * 6/1981 ..... B08B 15/023

OTHER PUBLICATIONS

Written Opinion of the International Searching Authority for related International Patent Application No. PCT/CN2016/071209, dated Apr. 12, 2016.

* cited by examiner

VENTILATION CABINET

CROSS-REFERENCE TO RELATED APPLICATIONS

This application is a U.S. National Stage of International Patent Application No. PCT/CN2016/071209, filed 18 Jan. 2016, which claims the benefit of Chinese Patent Application No. 201520216778.6, filed 10 Apr. 2015, both herein fully incorporated by reference.

FIELD OF THE INVENTION

The present invention relates to a fume hood, especially relates to an air supply type fume hood.

BACKGROUND

Fume hood can be generally described as a ventilated working space for catching, accommodating and discharging exhaust air, hazardous gas and particulate matter. Most of the traditional fume hoods are used to send a large amount of environmental air from the front opening of the fume hood into the work chamber of the fume hood while using a blower of large power to exhaust air in the work chamber to accommodate and process hazardous substances in the air. Under the design concept of the traditional fume hoods, the higher the air volume sent in from the front opening, the more effective the controlling and discharging function of the fume hood to the hazardous substances in the air is, thus, it is required to supply a large amount of air to the space of the fume hood through the ventilation air conditioning system of the building, such as the laboratory, to replace the environmental air sent into the fume hood from the front opening. Due to that the air supplied into the laboratory belongs to a part of the environmental air supplied for the laboratory, it must be processed into the same environmental air degree so as to ensure a comfortable and secure working environment of the laboratory, therefore, the use of the traditional fume hoods usually causes a great energy consumption of the buildings where laboratories and others are. Besides, unpredictable and inconsistent air flowing modes, such as the vortex type air group near the air outlet and the front opening will often happen. Under this situation, whatever the air velocity sent into from the front opening is, it will cause the risk of air leakage in the work chamber if the air system in the work chamber has turbulence or vortex, and it will threaten the health and safety of the experimenters. Therefore, new fume hood design structure and operation technology is highly required to cut down the energy consumption and reduce the leakage risk of hazardous substances in the work chamber.

At present, new type energy-saving and environment protective fume hoods in the fume hood market are all air supply type fume hoods. By disposing an air supply outlet on the upper or lower side of the work chamber and obtaining supplement air from the air supply power system of the building to blow into the work chamber of the fume hood, above design saves the air conditioning energy consumption of the building caused by air supplied in a certain degree. However, the single supplement air flow of current new type fume hoods cannot establish a stable air flow mode in the work chamber of the fume hood, so the problem of air turbulence and vortex is still unsolved, the leakage risk hazardous to the health and safety of the experimenters still exists. Besides, current fume hoods in the market all rely on the unified air supply system and air exhaust system of the building to obtain power, if a plurality of fume hoods are used at the same time, the amount of air supplied cannot realize individual adjustment depending on the required use condition, thus it will cause the result of a higher energy consumption. Moreover, during the installation and debugging process, the fume hood and its control system often use components in bulk to be temporarily assembled on site, therefore, it has the problem of high installation cost and poor consistency of product quality.

SUMMARY

The present invention provides a fume hood, which can reduce air conditioning energy consumption and prevent leakage of hazardous substances by containing them within the work chamber, with a low installation cost and a high consistency of product quality. To achieve the foregoing, the fume hood of the present invention, comprising: a hood, of which an inner cavity forms a work chamber, and a front wall is formed with an opening opened toward the indoor environment; an air supply system, which is connected with an air supply channel of the building to supply air to the work chamber; an air exhaust system, which is connected with an air exhaust channel of the building to discharge air that enters the work chamber through a front opening and enters the work chamber through the air supply system, out from the work chamber; the air supply system is provided with at least one air supply outlet in an upper part and a lower part of the hood respectively, said air supply outlet supplies air toward the work chamber; the hood is provided with a top module in the upper portion; said top module is mounted therein with an air supply blower and an air supply valve for the air supply system, and an air exhaust blower and an air exhaust valve for the air exhaust system; the air supply channels which connect the air supply blower and the air supply valve to each air supply outlet are communicated with each other.

Applying that structure, due to that the upper part and the lower part of the hood comprises at least one air supply outlet respectively, not only can the air amount sent from the front opening be reduced so as to reduce air conditioning energy consumption, but also the risk of air overflow in the work chamber is greatly reduced for that the plurality of air supply outlets are disposed to establish a stable push-pull type airflow mode. Besides, due to that the fume hood itself has an air exhaust blower, an air exhaust valve, an air supply blower and an air supply valve, it can flexibly design the air exhaust and supplement amount according to actual conditions, i.e., the distance to the overall power blower of the building, whether the operator is in the disposed region, to further benefit the energy consumption. And as above blowers and valves are integrated on the top module of the fume hood, there is no need to have on-site assembling or secondary design to the ventilation system of the building, thereby reduction of installation cost can be realized. Further, due to the highly integrated modularity design, the consistency of product quality can be ensured.

Preferably, the left and right side walls of the hood are hollow double-laminar structures, the air supply channel located on the upper portion of the hood and the air supply channel located on the lower portion of the hood are communicated through the hollow portion of the left and right side walls.

Applying that structure, the air supply channels of the upper and lower portions of the hood are communicated to each other through the hollow portion of the side wall, therefore, there is no need to dispose another connection pipe, it saves the space and simplifies the procedures when the user is installing the fume hood for the first time.

In addition, preferably, the air exhaust system is on the upper portion of the hood and an air exhaust region is provided close to the position of the rear wall of the hood; the air exhaust region extends in a whole left and right width direction of the hood, and is connected with the air exhaust blower and the air exhaust valve.

Applying that structure, the air exhaust system is disposed on the upper portion of the hood and close to the position of the rear wall of the hood, therefore, it is benefit for forming the said push-pull type airflow mode. In addition, due to that the air exhaust region extends in the whole left and right width direction of the hood, it can avoid the formation of air vortex near the top air exhaust outlet of the work chamber and provide possibility to the intercommunication of the whole air exhaust system including the following bottom air exhaust channel.

In addition, preferably, each said air supply outlet extends along a left and right width direction of the work chamber, respectively, the plurality of air supply outlets comprise therein: a first air supply outlet located above the front opening; a second air supply outlet located below the front opening; and a third air supply outlet located on the upper portion of the hood and on an outer side of the front wall, the third air supply outlet supplies air toward the work chamber and toward the lower side of the hood.

Applying that structure, it is benefit for forming above said push-pull type airflow mode. And due to that the air supply outlet along the left and right width direction of the work chamber, it can send out air uniformly and avoid the formation of turbulence. In addition, due to that the third air supply outlet blows wind downward, the downwardly blown wind is just in the breathing position of the operator, therefore, it will further reduce the risk of inhaling hazardous substances of the operator, and the downwardly blown wind forms an "air barrier", which can have the function of buffering the environmental air in the work chamber and outside the hood, thus it can effectively prevent the risk of overflow.

In addition, preferably, there is an inclined top wall that extends backwards and upwards from the first air supply outlet toward the air exhaust region in the work chamber.

Applying that structure, it can prevent the formation of vortex on the top portion of the work chamber and the air in the work chamber can climb slowly and uniformly from above first air supply outlet to above air exhaust region along the inclined top wall.

In addition, preferably, the work chamber is provided with an air baffle therein, the air baffle is vertically disposed close to the rear wall and the upper end portion extends toward the air exhaust region, a plurality of through holes are provided on the lower portion of the air baffle, the plurality of through holes are arranged in the whole left and right width direction of the air baffle.

Applying that structure, it is benefit for guiding the air in the work chamber to above air exhaust region so as to avoid the formation of air vortex, and due to that the through holes on the air baffle are arranged in the whole left and right width direction of the air baffle, it is benefit for providing basically consistent continues wind discharging to the whole width face of the work chamber.

In addition, preferably, at least one hood base is provided on the lower part of the hood; the inner cavity of the hood base is communicated with the air exhaust region through an air exhaust channel of the hood base; the air exhaust channel of the hood base is disposed in the hollow part of at least one side wall of the left and right side walls and extends along an up and down direction closing to the rear wall.

Applying that structure, hazardous air in the hood base caused by storing volatile reagent or toxic materials can be discharged to outside. And due to that the air exhaust channel of the hood base is disposed in the hollow part of the side wall, therefore, it saves the space and simplifies the procedures when the user is installing the fume hood for the first time.

In addition, preferably, each said air supply outlet is provided with at least one air baffle, respectively.

Applying that structure, it can minimize the turbulence and ensure the supplement airflow to blow out uniformly and slowly along the set direction.

a. In addition, preferably, the second air supply outlet is provided outwards with a protecting grid, that covers the second air supply outlet, the third air supply outlet is provided outwards with a protecting grid that covers the third air supply outlet.

Applying that structure, it can effectively reduce the material wastage of the air supply outlet and further help the bottom supplement air to become laminar flow that supplied into the work chamber, and it can also prevent sundries from coming into the air supply outlet.

In addition, preferably, the air supply blower and the air exhaust blower are power adjustable blowers, respectively, the air supply valve and the air exhaust valve are opening degree changeable blowers, respectively, the fume hood is also provided with: a sliding window, which can slide within the front opening and is for adjusting the open area of the front opening; a position sensor, which is provided in the top module and is for detecting the position of the sliding window; an air velocity transducer, which is disposed on the inner wall of the work chamber and close to the front opening, and is for detecting the velocity of the air entering into the work chamber from the front opening; an infrared detector, which is disposed on the front wall of the top module and is for detecting whether the operators are in the disposed region; and a control unit, which is located in the top module and is connected with the position sensor, the air velocity transducer, the infrared detector, the air supply blower and the air supply valve and the air exhaust blower and the air exhaust valve and adjusts the power of the air supply blower and the opening degree of the air supply valve and the power of the air exhaust blower and the opening degree of the air exhaust valve based on the detected information of the position sensor, the air velocity transducer and the infrared detector.

Applying that structure, the automatic control system could automatically adjust the power of the air supply blower and the opening degree of the air supply valve, and the power of the air exhaust blower and the opening degree of the air exhaust valve according to the actual using condition of the fume hood itself, which can reduce the air conditioning energy consumption. Also the structure is simple and convenient, which saves the space and greatly reduces the installation cost and maintenance cost of the fume hood.

DESCRIPTION OF PART SYMBOL

Figure 1:
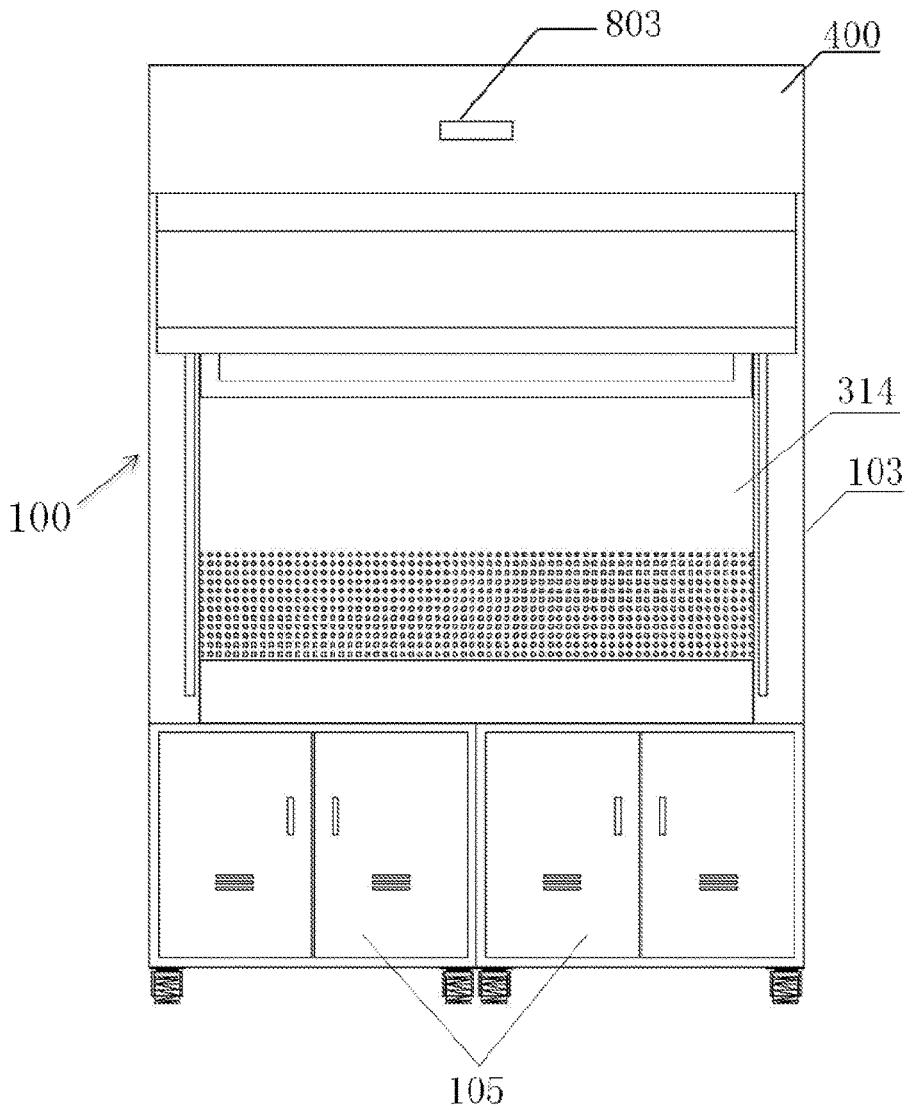
FIG. 1 is the front view of the fume hood of the preferable embodiment of the present invention.

100 hood
102 work chamber
103 left and right side walls
104 top wall
105 hood base
106 rear wall
108 bottom wall
109 inclined top wall
110 front opening
201 first air supply channel
202 second air supply channel
203 third air supply channel
211 air supply blower
212 air supply valve
311 air exhaust blower
312 air exhaust valve
313 gas-collecting hood
314 air baffle
315 rear duct
335 air exhaust region
400 top module
801 air velocity transducer
802 position sensor
803 infrared detector
804 sliding window
A1 first air supply outlet
A2 second air supply outlet
A3 third air supply outlet
A4 air supply overall outlet
B1, B2 hood base air exhaust channel
B4 air exhaust overall outlet

DETAILED DESCRIPTION

Here the figures will be referred to introduce the preferable embodiment of the present invention in details. Although the description of the present invention will be introduced together with the preferable embodiment, it does not represent that the features of the present invention are limited to the embodiment. On the contrary, the purpose of combining the embodiment to introduce the invention is to cover the choices or improvements based on the claims of the present invention or which may extend over it. In order to provide deep understanding of the present invention, the following description will contain many specific details. The present invention may not use to implement these details. Besides, in order not to confuse or bedim the key point of the present invention, some specific details will be omitted in the description.

Besides, "up", "down", "left", "right", "top" and "bottom" used in the following description are defined by the space position based on the fume hood used by the experimenters in the laboratory, while it should not be understood as the limitation to the present invention.

As shown in FIGS. 1-4, the fume hood of the preferable embodiment of the present invention comprises a hood 100, of which an inner cavity forms a work chamber 102, the hood 100 comprises: left and right side walls 103, a top wall 104, a rear wall 106, a bottom wall 108 and a front opening 110 formed on the front wall 101 and opened toward the indoor environment. In the present embodiment, the hood 100 is provided with two hood bases 105, which can be used for storing reagents and materials required by experiment.

The hood 100 is provided with a top module 400 peculiar in the upper portion thereof. The top module 400 is mounted therein with a power adjustable air supply blower 211, an opening degree adjustable air supply valve 212 located on the downstream side of the airflow direction of the air supply blower 211, a power adjustable air exhaust blower 311 and an opening degree adjustable air exhaust valve 312 located on the downstream side of the airflow direction of the air exhaust blower. Said air supply blower 211, air supply valve 212 and all the following mentioned air supply outlets, air supply channels constitute the air supply system, which is connected with the air supply channel of the building through the air supply overall outlet A4 to supply air to the work chamber 102. Said air exhaust blower 311, air exhaust valve 312 and all the following mentioned air exhaust region, air exhaust channels constitute the air exhaust system, which is connected with the air exhaust channel of the building through the air exhaust overall outlet B4 to discharge air that enters the work chamber 102 through the front opening 110 and enters the work chamber 102 through the air supply system, out from the work chamber 102.

Figure 4:
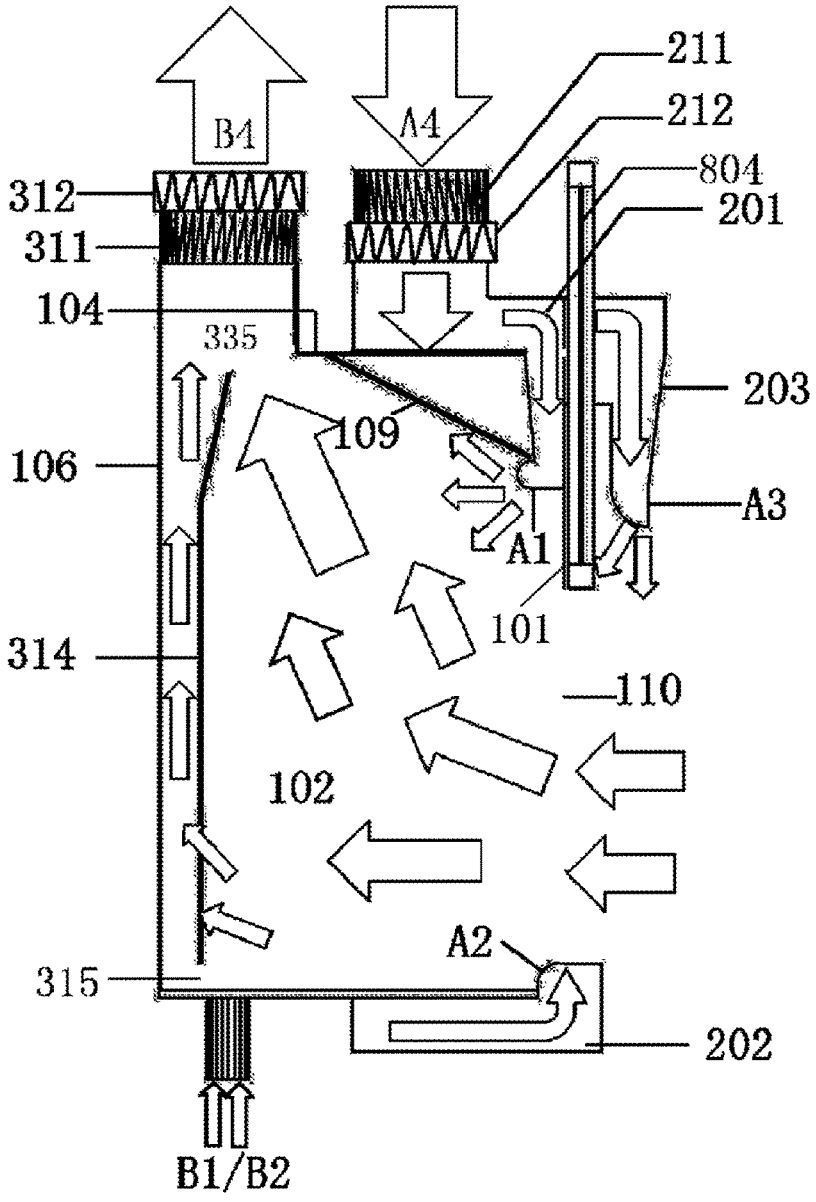
FIG. 4 is the airflow guide view of the fume hood of the preferable embodiment of the present invention.
Figure 5:
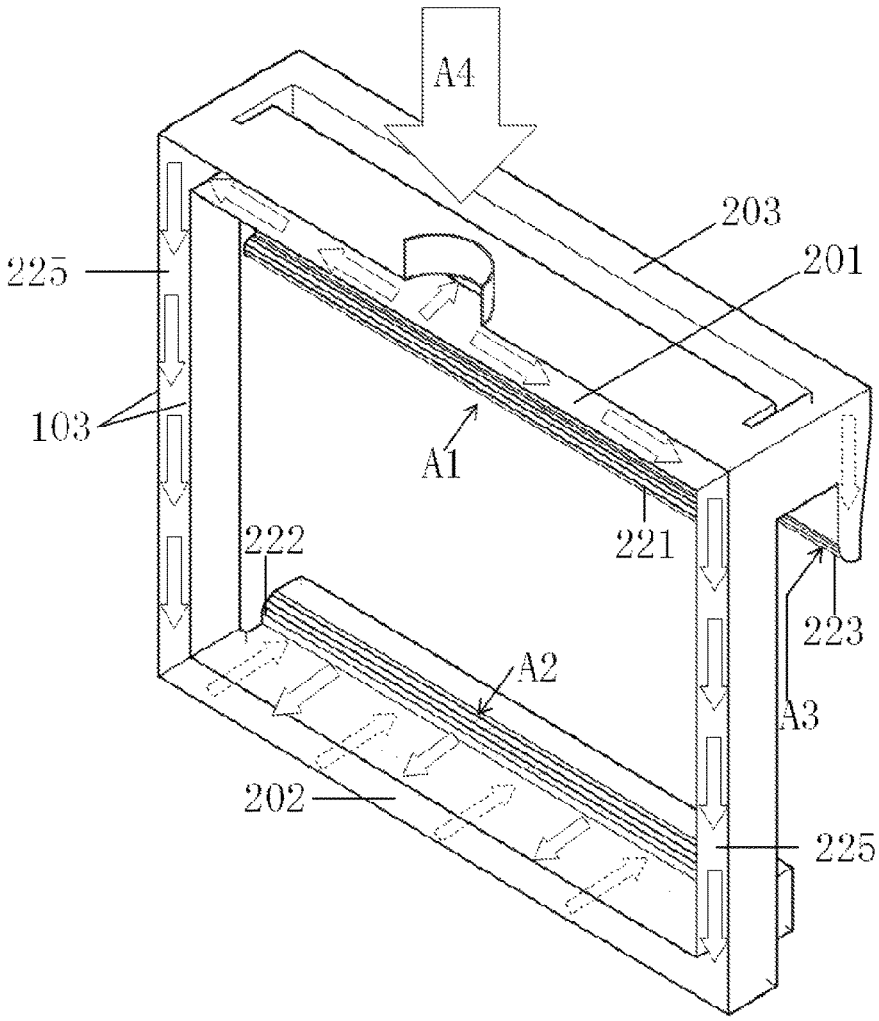
FIG. 5 is the airflow guide view of the air supply system of the fume hood of the preferable embodiment of the present invention.

FIG. 4 is the airflow guide view of the fume hood of the present embodiment. FIG. 5 is the airflow guide view of the air supply system of the fume hood of the present embodiment. As shown in FIGS. 4, 5, a first air supply outlet A1 is disposed above the front opening 110, the first air supply outlet A1 is designed to be a semi-cylindrical surface shape which extends along the left and right width direction of the work chamber 102, its semi-cylindrical surface faces toward the work chamber 102, that is, facing toward the rear side. The first air supply outlet A1 is provided thereon with plurality of air baffles 221 (as shown in FIG. 5) which extend along the axial direction of the semi-cylindrical surface and are arranged along the circumferential direction of the semi-cylindrical surface. The upper portion of the hood is provided with a first air supply channel 201 across the left and right width direction of the hood, the first air supply channel 201 connects the air supply valve 212 with the first air supply outlet A1. As seen in the figures, one of the vertical wall constituting the first air supply channel 201 is designed as an inclined wall in the direction of air flow. The inclined wall can uniformly redistribute the air moving in the first air supply channel 201 and reduce its air velocity. Thus, by operating the air supply blower 211, the first air supply outlet A1 uniformly and slow sends the supplied air into the work chamber 102 of the fume hood along the radial direction of the semi-cylindrical surface. Although the airflow sent to the first air supply outlet A1 from the air supply blower 211 still has a certain proportion of turbulence (about less than 15%), the setting of the air baffles 221 can block the overflow and ensure the airflow blown into the work chamber 102 from the first air supply outlet A1 to be a laminar flow state.

A second air supply outlet A2 is disposed below the front opening 110, the second air supply outlet A2 is designed to be a ¼ cylindrical surface shape which extends along the left and right width direction of the work chamber 102, its ¼ cylindrical surface faces toward the work chamber 102, that is, facing toward the rear upper side. The second air supply outlet A2 is provided thereon with plurality of air baffles 222

(as shown in FIG. 5) which extend along the axial direction of the ¼ cylindrical surface and are arranged along the circumferential direction of the ¼ cylindrical surface. The lower portion of the hood is provided with a second air supply channel 202 across the left and right width direction of the hood, the second air supply channel 202 transfers the air from the air supply blower 211 to the second air supply outlet A2, therefore, the supplied air can be uniformly blown into the work chamber along the radial direction of the ¼ cylindrical surface. In addition, due to that the second air supply outlet A2 is located in the working region of the fume hood, the air baffles in this region will have risk of wastage caused by frequent usage, therefore, in the present embodiment, the second air supply outlet A2 is provided with a protecting grid (not shown) outside that surrounds the second air supply outlet to prevent the air baffles 222 from risk of wastage, and the protecting grid can also help to guide the supplement airflow of the second air supply outlet A2 and is benefit for forming the air sent from the second air supply outlet A2 into the laminar flow state so as to be supplied into the work chamber 102. In additional, the protecting grid can also have the function of prevent the sundries from coming into the second air supply outlet A2.

A third air supply outlet A3 is disposed on the upper portion of the hood 110 and on the front side of the front wall 101, the third air supply outlet A3 is designed to be a ¼ cylindrical surface shape which extends along the left and right width direction of the work chamber 102, its ¼ cylindrical surface faces toward the work chamber 102, that is, facing toward the rear lower side. The third air supply outlet A3 is provided thereon with plurality of air baffles 223 (as shown in FIG. 5) which extend along the axial direction of the ¼ cylindrical surface and are arranged along the circumferential direction of the ¼ cylindrical surface. The upper portion of the hood is provided with a first air supply channel 201 across the left and right width direction of the hood, the first air supply channel 201 connects the air supply valve 212 with the first air supply outlet A1. The side of the first air supply channel 201 close to the work chamber 102 is designed as an inclined wall. The upper portion of the hood is provided with a third air supply channel 203 across the left and right width direction of the hood, the following said sliding window 804 can be mounted between the third air supply channel 203 and the first air supply channel 201, the third air supply channel 203 turns around the sliding window 804 and then connects with the first air supply channel 201 so as to transfer the air from the air supply blower 211 to the third air supply outlet A3. The side of the third air supply channel 203 away from the hood is designed as an inclined wall, which uniformly distributes the air moving in the third air supply channel 203 and reduces the air velocity. Under the function of the air supply blower 211, the supplied air can be uniformly blown along the radial direction of the third air supply outlet A3. The third air supply outlet A3 not only sends air to the work chamber of the hood 100, but also sends air to the lower side of the hood 100. The downwardly blown wind is just in the breathing position of the experimenter, therefore, it will further reduce the risk of inhaling hazardous substances of the experimenter, and the downwardly blown wind from the third air supply outlet A3 forms an "air barrier", which can have the function of buffering the environmental air in the work chamber 102 and outside the hood, it can effectively prevent the risk of overflow. In the present embodiment, the third air supply outlet A3 is also provided with a protecting grid outside that surrounds the third air supply outlet A3. The protecting grid also has the function of preventing the air baffles from wastage, guiding the supplement airflow and preventing the sundries from coming into the air supply outlet.

As shown in FIG. 5, the left and right side walls 103 of the hood 100 are hollow double laminar structures, the first air supply channel 201 located on the upper portion of the hood and the second air supply channel 202 located on the lower portion of the hood are communicated through the hollow portion 225 of the left and right side walls. From above, all the air supply channels of the present embodiment are communicated with each other, so that the air supply amount of the fume hood can be uniformly adjusted by the opening degree of the air supply blower 211 and the air supply valve 212.

Figure 2:
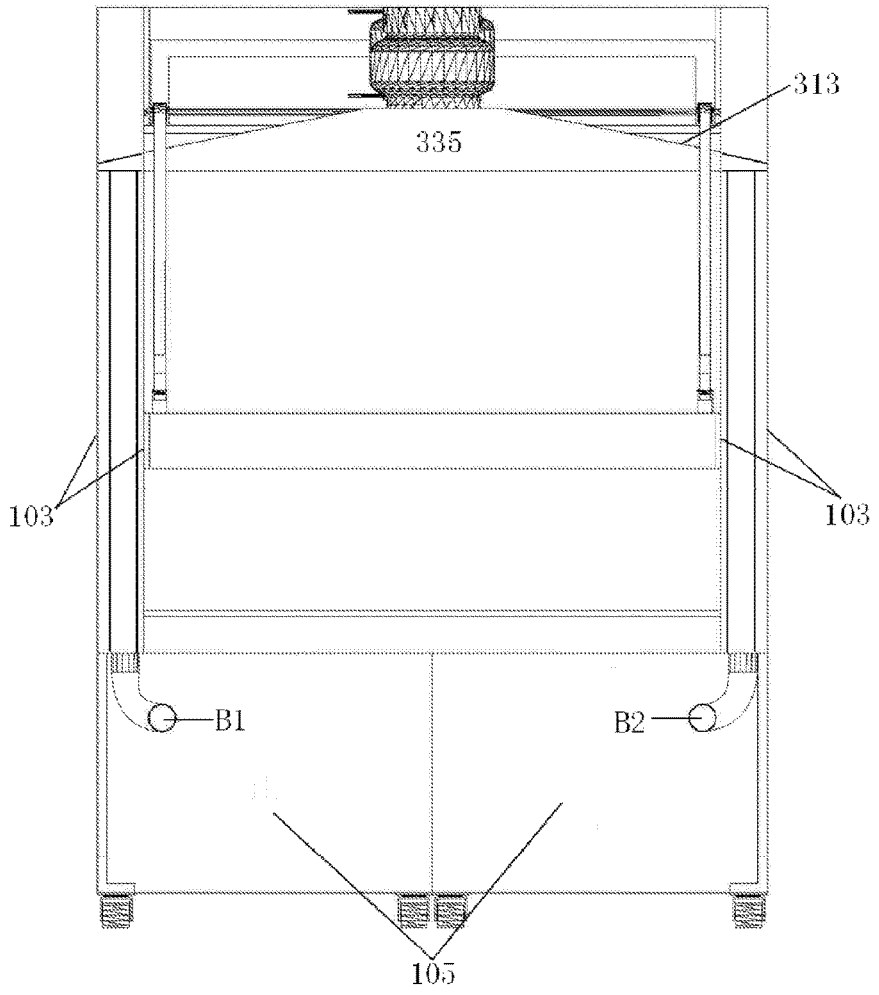
FIG. 2 is the back section view of the fume hood of the preferable embodiment of the present invention.

As shown in FIGS. 2, 4, a gas-collecting hood 313 across the whole left and right width direction of the hood 100 is disposed on the upper portion of the hood and close to the position of the said rear wall 106. The upper end of the gas-collecting hood 313 is connected with the air exhaust blower 311; its inner structure forms an air exhaust region 335 extending in the whole left and right width direction of the hood 100. By disposing such air exhaust region 335, it can avoid the forming of air vortex near the top air exhaust outlet of the work chamber 102 and provide possibility to the interconnection of the whole air exhaust system including the following hood base's air exhaust channel.

As shown in FIG. 4, in the present embodiment, the said work chamber 102 also comprises an inclined top wall 109 that extends backwards and upwards inclinedly from the first air supply outlet A1 toward the said air exhaust region 335, the inclined top wall 109 forms a part of surrounding regarding to the work chamber 102, two sides of the inclined top wall 109 are connected with the left and right side walls of the hood, the bottom end is connected with the upper edge of the first air supply outlet A1, and the top end is connected with the top wall 104. Due to the high air exhaust working amount of the air exhaust blower, the inner top portion of the work chamber of the traditional fume hood will often form air vortex, so that hazardous and toxic gas cannot be discharged, the design of the inclined top wall can break the enlargement of the vortex, cooperating with the laminar flow wind sent by the first air supply outlet A1 in the top portion of the hood, the air inside the work chamber can climb slowly and uniformly to the air exhaust region along the inclined wall. The angle and design shape of the inclined top wall 109 help to control and prevent the overflow of the hazardous substances in the air inside the work chamber 102 and reduce the possibility of formation of vortex of the air near the air exhaust region 335 on the top portion. In additional, as shown in FIGS. 1, 4, in the said work chamber 102, an air baffle 314 is also disposed close to the position of the rear wall 106; the upper end portion of the air baffle 314 extends toward the said air exhaust region 335; a plurality of through holes are provided on the lower portion of the air baffle 314; the plurality of through holes are arranged in the whole left and right width direction of the air baffle 314; rear duct 315 is formed between the air baffle 314 and the bottom wall 108 of the hood. By disposing the air baffle 314 having through holes, it can stably guide the air inside the work chamber 102 to the top air exhaust region 335 so as to avoid the formation of air vortex, and it can conduct basically consistent and continuous wind discharging in the whole width face of the work chamber.

The arrow in FIG. 4 shows the all the airflow when entering, passing and being discharged from the hood of the fume hood. With the function of the air supply blower 211 and the air supply valve 212, the supplement airflow enters from the overall air supply outlet A4 into the air supply system of the fume hood and flows to each air supply outlet A1, A2 and A3 and further uniformly and slowly enters into the work chamber 102, at the same time, a part of the environmental air will enter into the work chamber 102 from the front opening 110 at an angle vertical to the front opening 110. After the air has entered into the work chamber 102, as shown by the arrow, basically, it will be uniformly pulled to and through the top air exhaust region 335, the air baffle 314 and the rear duct 315, then being discharge from the overall air supply outlet A4 of the top portion of the hood along the arrow direction. It is clear to the skilled in the field: the change of the airflow area will cause fluctuation to the airflow velocity. Therefore, when the air from the front opening 110 is entering into the large region of the work chamber 102, the air velocity will be decreased; when the air continuously flows to the vicinity of the air exhaust region 335 of the top portion, the air velocity will be increased. This fluctuation of air velocity will help to maintain a consistent and stable air supply and exhausting push-pull system. The push-pull type system can move the air in the hood in a synchronous displacement way, thus it can greatly reduce the required air supply amount and the turbulence risk of the air inside the hood. Besides, the push-pull type system and the inclined top wall 109 used in the present embodiment can minimize the risk of formation of the air turbulence and vortex in the hood, especially the air above the work chamber 102 and the front opening 110. Therefore, it can more effectively control the possibility of the overflow of hazardous substances in the hood from the front opening by the push-pull air moving type system.

Figure 6:
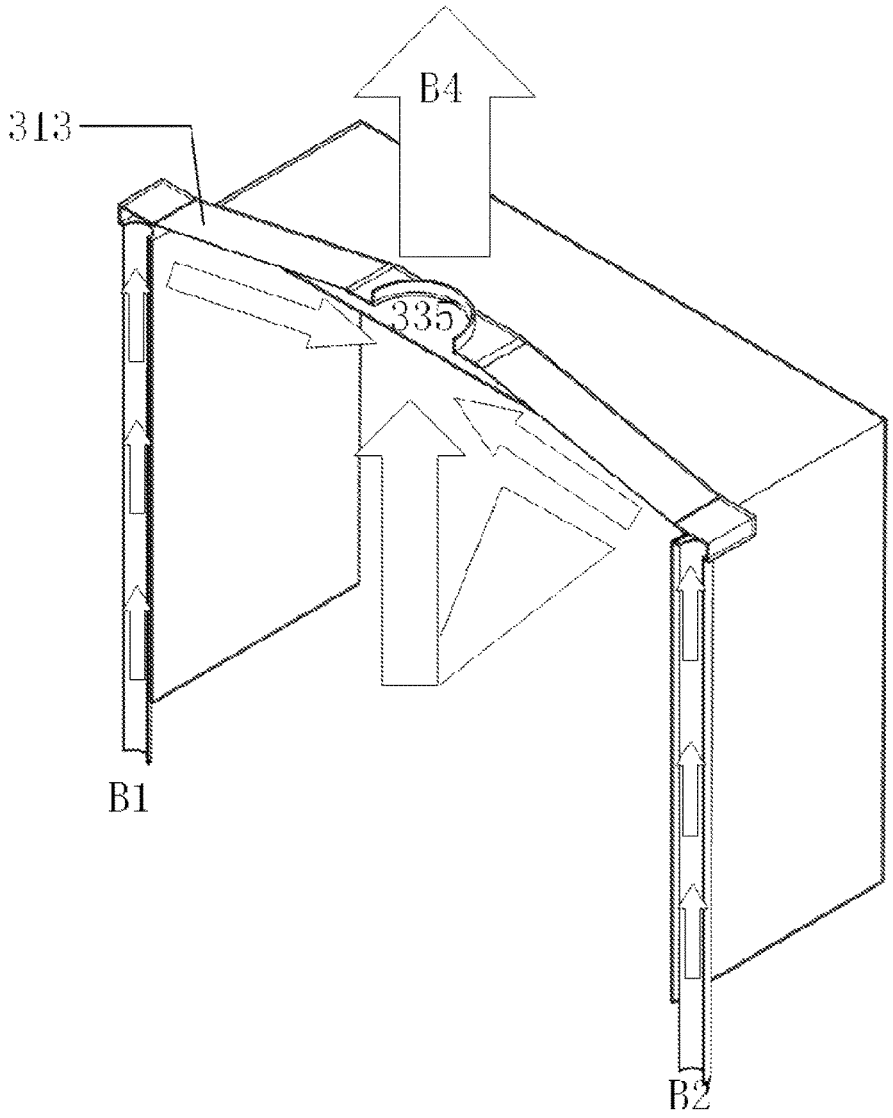
FIG. 6 is the airflow guide view of the air exhaust system of the fume hood of the preferable embodiment of the present invention.

FIG. 6 is the airflow guide view of the air exhaust system of the fume hood of the present embodiment. In order to discharge the toxic and hazardous gas in two hood bases 105 of the fume hood due to placing working reagents or materials, as shown in FIGS. 2, 6, the rear portions of two hood bases 105 of the fume hood of the present embodiment are provided with bottom air exhaust channels B1 and B2, respectively. The bottom air exhaust channels B1 and B2 are respectively disposed in the corresponding hollow portions of the left and right side walls 103 and extend along the up-down direction close to the said rear wall 106 to communicate the inner cavity of the corresponding hood base 105 with the air exhaust region 335 inside the gas-collecting hoop 313 of the top portion of said hood. Thereby, with the function of the air exhaust blower 311, the air inside the hood base 105 can be extracted from the bottom air exhaust channels B1 and B2 and mixed with the airflow pushed and pulled from the work chamber 102 in the air exhaust region 335, and being discharged together from the overall air exhaust outlet B4 to the air exhaust channel of the building. From above, similar to the air supply system, each air exhaust channel of the fume hood of the present invention is also related to each other, so the overall air exhaust amount can be controlled by the power of the air exhaust blower 311 and the opening degree of the air exhaust valve 312.

Figure 3:
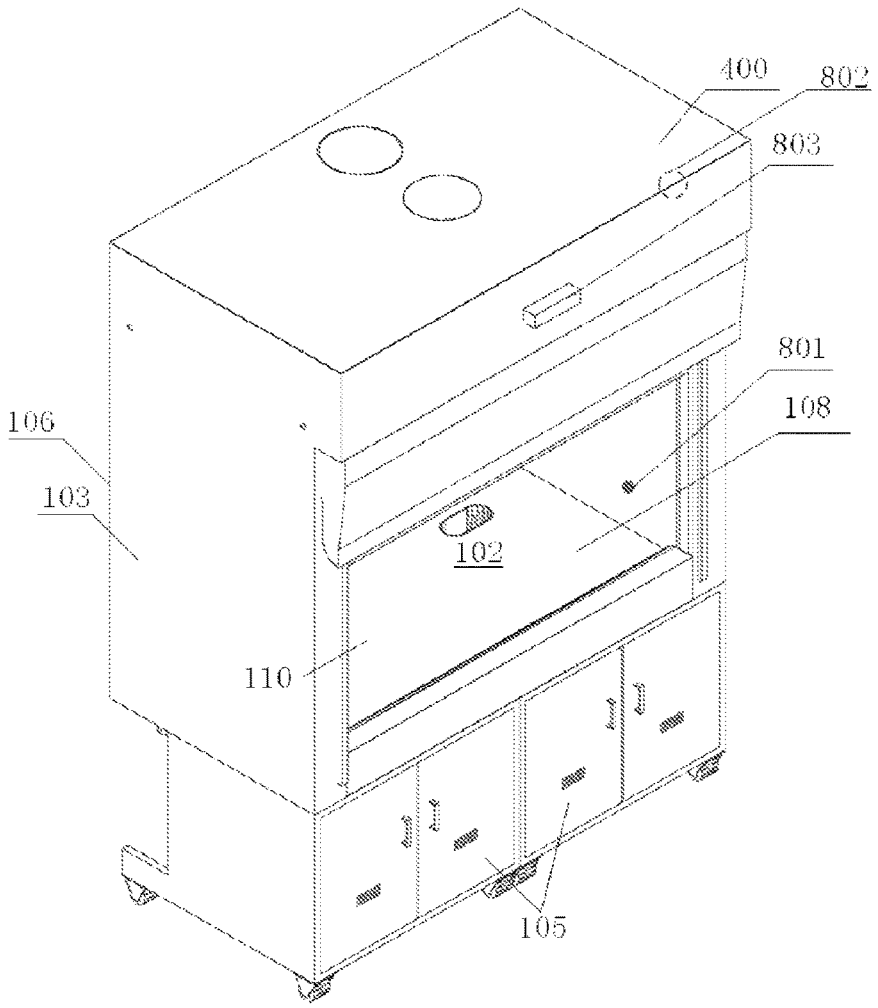
FIG. 3 is the space view of the fume hood of the preferable embodiment of the present invention.

Further, the fume hood of the present embodiment can cooperate with the control system to be used as a variable air volume fume hood; the entering amount of the air at the front opening can be flexibly changed in a great range by means of the position change of the sliding window. Specifically, as shown in FIGS. 3, 4, in the present embodiment, the fume hood is also provided with: a sliding window 804, which can slide within the said front opening 110 and is for adjusting the open area of the front opening 110; a position sensor 802, which is provided in the said top module 400 and is for detecting the position of the said sliding window 804; an air velocity transducer 801, which is disposed on either of the said left and right side walls 103*a* nd close to the front opening 110, and is for detecting the velocity of the air (hereinafter referred as surface air velocity) entering into the work chamber 102 from the front opening 110; an infrared detector 803, which is disposed on the front wall 101 of the top module 400 and is for detecting whether the operators are in the disposed region; and a control unit (not shown), which is located in the top module 400 and is connected with the said position sensor 802, said air velocity transducer 801, said infrared detector 803, said air supply blower 211, said air supply valve 212, said air exhaust blower 311 and said air exhaust valve 312 and adjusts the power or opening degree of the air supply blower 211 and the air supply valve 212, and the air exhaust blower 311 and the air exhaust valve 312 based on the detected information of the said position sensor 802, the air velocity transducer 801 and the infrared detector 803.

The infrared detector 803 can perceive whether the experimenters are in the disposed working region. If it detects that no one is in the working region and the sliding window 804 of the fume hood is not in a close state, the control unit will send signal to the driving device (not shown in the figures) of the sliding window 804 to close the sliding window 804 so as to reduce the air amount entered into the work chamber from the indoor environment and reduce energy consumption of the laboratory. Besides, after the sliding window 804 is closed, the air entering amount of the fume hood is only provided by each air supply outlets A1-A3, the air exhaust amount of the fume hood will decrease at the same time, thus the system energy consumption of the fume hood will also decrease.

Furthermore, when the opening of the sliding window 804 changes, the control unit receives the new position coordinates of the sliding window sent by the position sensor 802, and calculates the new fume hood air exhaust amount required for maintaining the surface air velocity according to following formula:

$$Q=V*S*3600 \quad (1)$$

Q is the air exhaust amount of the work chamber 102 of the fume hood, of which the unit is $m^3/h$; V is the preset value of the surface air velocity, of which the unit is m/s; S is the area of the ventilation sectional area of the sliding window 804, that is, the area of the front opening 110, of which the unit is $m^2$, wherein, $$S=L*H \quad (2)$$

L is the width of (when the sliding window 804 is moving up and down) or the height (when the sliding window 804 is moving left and right) of the sliding window 804, which is a fixed value; while H is the opening degree of the sliding window 804 detected by the said position sensor 802.

Then the control unit obtains the air exhaust amount of the work chamber 102 of the fume hood by calculation and combines the air exhaust amount value of the bottom air exhaust channels B1 and B2 to adjust the power of the air exhaust blower 311 and the opening degree of the air exhaust valve 312 so as to change the air exhaust amount value of the whole fume hood. And accordingly the power of the air supply blower 211 and the opening degree of air supply valve 212 are adjustable to change the air supply amount value of the air supply system.

When a plurality of fume hoods are parallelly connected in the ventilation system of the building, the air supply and exhausting amount of each fume hood subject to its particular using condition will be different. People skilled in the field well knows that, in the whole airflow system, the closer the distance to the overall power blower is, the more the supplied or discharged airflow amount will be; the farther the distance to the overall power blower is, due to pressure drop and wastage, the less the supplied or discharged airflow amount will be. Thus, without the control of the valve, each fume hood cannot realize individual adjustment subject to the particular using condition only by the overall power blower. In order to solve the above problem, most of the new environmental VAV fume hoods in the current market are mounted with venture valves of high cost. In the present embodiment, as said above, due to that the fume hood is integrated with the top module 400, while the top module 400 is mounted therein with the exhausting blower 311, the air exhaust valve 312, the air supply blower 211 and the air supply valve 212 of which the power and opening degree can be adjusted according to actual conditions, and the power and opening degree of above blowers and valves can be adjusted by the automatic control system, therefore, it can have the identical function as the venture valves; and it has a simpler structure and saves more space, while greatly reduce the installation cost and maintenance cost of the fume hood.

Above is the description to the preferable embodiment of the present invention, but the present invention is not limited to this, it can be measured by conducting various deformation not out of its proposed range.

For example, in the said embodiment, two air supply outlets are provided on the upper portion of the hood, one air supply outlet is provided on the lower portion of the hood, and one air exhaust region is provided on the upper portion of the hood and close to the position of the rear wall of the hood, but the disposed position and number of the air supply outlet and the air exhaust region is not limited to this, only if the push-pull type airflow mode can be formed in the work chamber.

Also, in the said embodiment, the air supply blower and the air exhaust blower are power adjustable blowers, respectively, the air supply valve and the air exhaust valve are opening degree changeable blowers, respectively, but the present invention is not limited to this, only if at least one of the blower and the value is disposed to be adjustable. Besides, without the requirement of adjusting the air amount, it only needs to dispose the fixed power of the blower and the fixed opening degree of the valve according to the distance of the fume hood to the system overall power blower.

Also, in the said embodiment, the air supply valve and the air exhaust valve are disposed on the downstream side of the airflow direction of the air supply blower and the air exhaust blower, but the present invention is not limited to this, the air supply valve and the air exhaust valve can be also disposed on the upstream side of the airflow direction of the air supply blower and the air exhaust blower.

Also, in the said embodiment, the sliding window is disposed to adjust the air amount entering from the front opening of the fume hood, but the present invention is not limited to this, without the requirement of adjusting the air entering amount, it can dispose no sliding window to reduce to cost.

Also, in the said embodiment, the hood is provided with two hood bases in the lower side for storing reagents and materials required by the experiment, but the present invention is not limited to this, the number of the hood base can be appropriately disposed according to requirements, or without disposing the hood base. Besides, the number and position of the bottom air exhaust channel can be just appropriately disposed corresponding to the number and position of the hood base.

Also, in the said embodiment, the air velocity transducer for detecting the surface air velocity is disposed on the inner surface of the side wall, but the present invention is not limited to this, the air velocity transducer can be also disposed on the inner wall of the work chamber, such as the bottom wall or the top wall, if not the surface air velocity can be detected without bothering the experimental operation.

Also, in the said embodiment, the fume hood is a fume hood for experiment, but except for this, the fume hood of the present invention can be applied to any works which need to control and discharge hazardous substances in air, such as wet etching cleaning system required in semiconductor industry and so on.

What is claimed is:

1. A system, comprising:

a fume hood and a top module above the fume hood, the fume hood comprising a hood including an upper portion; a lower portion; a work chamber; a rear wall; a front wall formed with an opening toward an indoor environment;

an air supply system, configured to connect to a building air supply channel to supply air to the work chamber;

an air exhaust system, configured to connect to a building air exhaust channel to discharge air that enters the work chamber, wherein the air supply system comprises a first air supply outlet in the upper portion of the hood and inside the front wall for supplying air into the work chamber, a second air supply outlet in the lower portion of the hood for supplying air into the work chamber, and a third air supply outlet in the upper portion of the hood and outside the front wall for supplying air into the work chamber and toward the lower portion of the hood;

a first air supply channel located on the upper portion of the hood and configured to connect an air supply blower and an air supply valve to the first air supply outlet;

a second air supply channel located on the lower portion of the hood and configured to connect the air supply blower and the air supply valve to the second air supply outlet;

a third air supply channel located on the upper portion of the hood and configured to connect the air supply blower and the air supply valve to the third air supply outlet;

a sliding window located between the first air supply channel and the third air supply channel, and configured to slide within the front opening and for adjusting an open area of the front opening; and a hollow left side wall and a hollow right side wall, wherein the first air supply channel, the second air supply channel and the third air supply channel are communicated through the hollow left and right side walls;

the top module comprising the air supply blower and the air supply valve for the air supply system and an air exhaust blower and an air exhaust valve for the air exhaust system, wherein the air supply blower and the air exhaust blower are power adjustable blowers, the air supply valve and the air exhaust valve are opening degree changeable valves, and wherein, the fume hood further comprises:

a position sensor for detecting a position of the sliding window, an air velocity transducer for detecting velocity of air entering into the work chamber from the front opening, an infrared detector for detecting whether operators are in a disposed region; and a control unit, that connects with the position sensor, the air velocity transducer, the air supply valve and the air exhaust valve, and adjusts the opening degree of the air supply valve and the opening degree of the air exhaust valve based on detections of the position sensor and detections of the air velocity transducer, wherein the air exhaust system further comprises an air exhaust region, which is provided on the upper portion of the hood and close to the rear wall of the hood, said air exhaust region extending in a left and a right width direction of the hood, and configured to connect with the air exhaust blower and the air exhaust valve, and wherein the lower portion of the hood includes at least one hood base, the hood base including an inner cavity that connects with the air exhaust region through a hood base air exhaust channel, said hood base air exhaust channel disposed in at least one of the hollow left and right side walls and extending along an up and down direction closing to the rear wall.

2. The system according to claim 1, further comprising, an inclined top wall that extends backwards and upwards from the first air supply outlet toward the air exhaust region in the work chamber.

3. The system according to claim 1, wherein, the work chamber comprises an air baffle therein, the air baffle vertically disposed close to the rear wall and including an upper end portion extending toward the air exhaust region, and a lower portion including a plurality of through holes, the plurality of through holes arranged in a left and a right width direction of the air baffle.

4. The system according to claim 1, wherein, each said first, second, and third air supply outlet includes at least one air baffle.

5. The system according to claim 1, wherein, the second air supply outlet includes a first protecting grid, said first protecting grid covering the second air supply outlet, and the third air supply outlet includes a second protecting grid, said second protecting grid covering the third air supply outlet.

6. The system according to claim 1, wherein, the opening degree of the air exhaust valve is further based on detections of the infrared detector.

* * * * *